US008066005B2

(12) United States Patent
Lin

(10) Patent No.: US 8,066,005 B2
(45) Date of Patent: Nov. 29, 2011

(54) COMPLEX RESPIRATOR

(76) Inventor: Jing-Jyr Lin, Taoyuan County (TW)

( * ) Notice: Subject to any disclaimer, the term of this patent is extended or adjusted under 35 U.S.C. 154(b) by 995 days.

(21) Appl. No.: 11/503,075

(22) Filed: Aug. 14, 2006

(65) Prior Publication Data

US 2010/0269832 A1 Oct. 28, 2010

Related U.S. Application Data

(63) Continuation-in-part of application No. 11/335,073, filed on Jan. 18, 2006, now Pat. No. 7,237,550.

(51) Int. Cl.
*A62B 23/02* (2006.01)

(52) U.S. Cl. ..... 128/206.12; 128/205.27; 128/205.29; 128/206.21; 128/206.28

(58) Field of Classification Search ..... 128/201.15, 128/205.27, 205.29, 206.13, 206.16, 206.18, 128/206.19, 206.25, 206.17
See application file for complete search history.

(56) References Cited

U.S. PATENT DOCUMENTS

| | | | | |
|---|---|---|---|---|
| 4,501,272 | A * | 2/1985 | Shigematsu et al. | 128/206.15 |
| 4,945,907 | A * | 8/1990 | Tayebi | 128/206.12 |
| 6,530,374 | B1 * | 3/2003 | Ferraro | 128/206.29 |
| 6,742,518 | B2 * | 6/2004 | Chang | 128/205.29 |
| 6,761,162 | B1 * | 7/2004 | Swann | 128/201.25 |
| 6,817,362 | B2 * | 11/2004 | Gelinas et al. | 128/206.17 |
| 7,008,469 | B2 * | 3/2006 | Vetter et al. | 96/67 |
| 7,415,981 | B1 * | 8/2008 | Pinson et al. | 128/201.25 |
| 2005/0076627 | A1 * | 4/2005 | Itou et al. | 55/523 |
| 2005/0139217 | A1 * | 6/2005 | Chiam | 128/206.19 |

* cited by examiner

*Primary Examiner* — Justine Yu
*Assistant Examiner* — Latoya M Louis
(74) *Attorney, Agent, or Firm* — Rosenberg, Klein & Lee

(57) ABSTRACT

A complex respirator is provided that includes a first shell, at least a first filter layer and a second filter layer. The first filter layer is replaceable and arranged on an outer side of the first shell while the first shell is disposed on an outer side of the second filter layer. A slot is formed on an outer side of the first shell for accommodating the first filter layer. The filtering area of the first filter layer is smaller than that of the second filter layer while pore size of the first filter layer is larger than that of the second filter layer. The second filter layer filters the gas that the first filter layer is unable to filter. Moreover, the type of first filter media of the first filter layer may be chosen based on the location that the complex respirator is to be used.

18 Claims, 13 Drawing Sheets

COMPLEX RESPIRATOR

REFERENCE TO RELATED APPLICATIONS

This Application is a Continuation-in-Part of patent application Ser. No. 11/335,073, filed 18 Jan. 2006, now U.S. Pat. No. 7,237,550.

BACKGROUND OF THE INVENTION

The present invention relates to a complex respirator, especially to a complex respirator with replaceable filter so that the storage of the respirator is easier and the filter is selectable with various pore sizes for filtering different kinds of gas.

The problem of air pollution is getting worse nowadays. No matter whether the pollution is from a dust storm, heavy smoke discharged from the factory, vehicle exhaust emission, or even smoke from waste combustion, all include toxic gas or granules harmful to human bodies, both are health risk factors. For the sake of protection and prevention, people wear respirators all the time so as to avoid inhalation of toxic gas and harmful granules while going out. Thus, the use rate of the respirator has risen. Most of the conventional respirators are disposable and have charcoal or "filtering fiber as filter media. Referring to FIG. 1, the fiber shown is disclosed in U.S. Pat. No. 6,234,171, B1—MOLDED RESPIRATOR CONTAINING SORBENT PARTICLES. The respirator is disposed with fiber 1 attached with sorbent particles 12. Because a unit area of the fiber 1 only adheres a certain amount of the sorbent particles 12, the sorbent particles 12 are easily saturated and are then unable to absorb any more toxic or harmful material.

Furthermore, the conventional flat respirator can't attach on a user's face tightly, so that a gap is formed between the edge of the respirator and the face skin. While wearing the flat respirator, part of the air with toxic gas or granules may flow through the gap and the gas enters the user's body. Thus a respirator 20 with a cartridge 22 in FIG. 2 was developed. The traditional cartridge is filled with an adsorbent material as a filter media for filtering the air. Generally, the absorbent material is charcoal to absorb organic solvents and granules. However, the breathing area of the respirator 20 with the cartridge 22 is limited inside the cartridge 22 and includes pores with a small diameter. Therefore, such a respirator makes breathing difficult. In order to get more air flow, people need to breathe more heavily. Although the purpose of avoiding toxic gas or harmful materials is achieved, people feel uncomfortable while breathing. Thus people would not like to wear that kind of respirator while going out to areas with polluted air.

With either the conventional flat respirator or the respirator with the cartridge, the whole respirator needs to be thrown away when the filter is saturated and unable to be used anymore. This causes a kind of waste. Not only do those working in special locations, such as hospitals, use respirators, but also ordinary people do as well. Thus, there is a need to improve the way used filter material is replaced.

Due to a worsening environment, air pollution has become a pressing problem of public health. Thus, the present invention provides a complex respirator that not only protects people from inhaling toxic gas and harmful granules, but also allows users to breathe more smoothly. Moreover, only the filter layer of the respirator needs to be changed and the service time of the respirator is thereby extended.

SUMMARY OF THE INVENTION

Therefore it is a primary object of the present invention to provide a complex respirator that includes a replaceable first filter layer so that users can choose material of the first filter layer depending on places they intend to go. Thus toxic gas or harmful granules in the air people have inhaled will have been filtered.

It is another object of the present invention to provide a complex respirator that includes two filter layers made from different materials with a different area and pore size, so as to filter different granules. Thus, users won't inhale toxic gas or harmful granules in the air.

It is a further object of the present invention to provide a complex respirator with a replaceable filter layer, where the used filter layer is able to be replaced with a new filter layer directly. Thus, the service life of the respirator is extended.

It is a further object of the present invention to provide a complex respirator that includes a chamber therein for buffering pressure coming from air-breathing, so that people using this respirator can breathe smoothly and comfortably.

A complex respirator according to the present invention includes at least a first filter layer, a first shell, and a second filter layer. The first shell is disposed on inner side of the first filter layer while the second filter layer is arranged on the inner side of the first shell. The material of the first filter layer can be changed according to the user's needs. The first filter layer has a larger pore size than that of the second filter layer, while the second filter layer has a larger area than that of the first filter layer. An air chamber is formed between the second filter layer and the first shell so as to make air inhaled or exhaled flow through the first filter layer and the second filter layer uniformly. The present invention further includes a second shell arranged on outer side of the first filter layer for preventing the first filter layer from exposure to water. Moreover, the second shell and the first shell together form an open space facing downwards allowing the inhaled or external air to flow therethrough.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
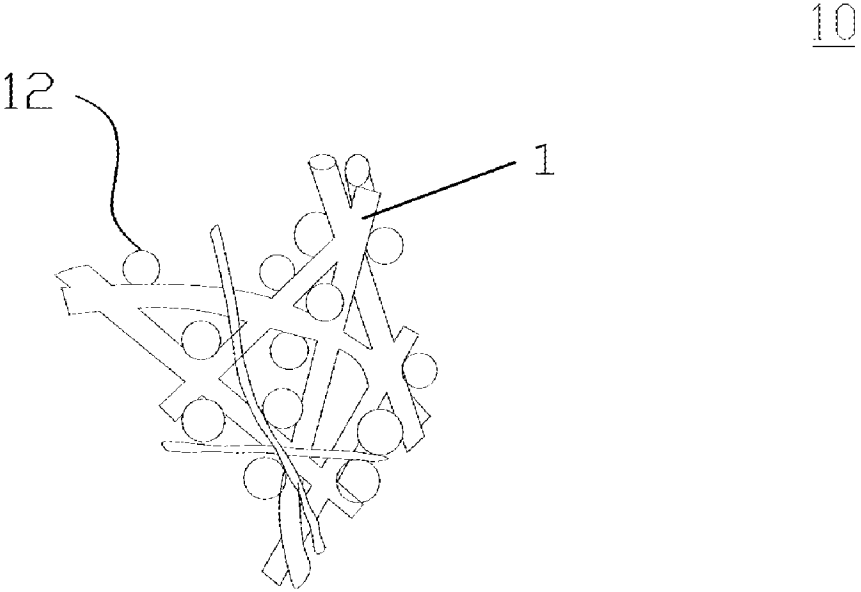
Fig. 1(prior art)
FIG. 1 is schematic drawing showing fiber of conventional flat respirators.
Figure 2:
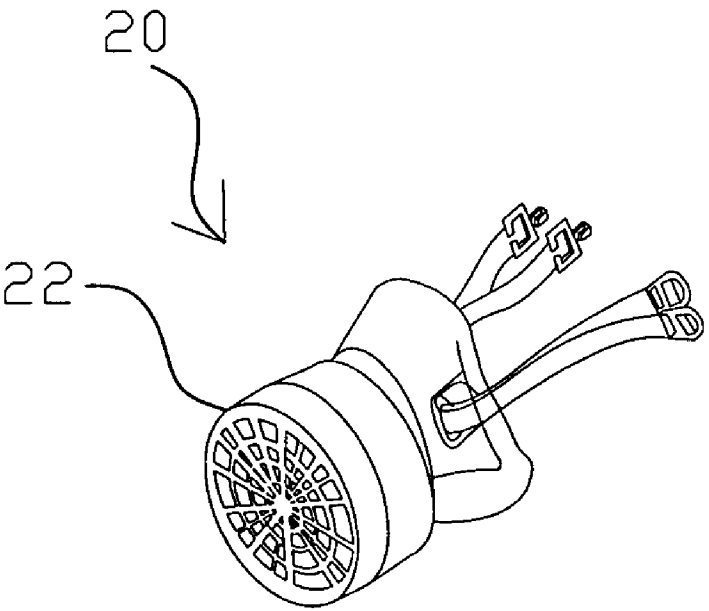
Fig. 2(prior art)
FIG. 2 is schematic drawing showing a traditional respirator with a cartridge.
Figure 3:
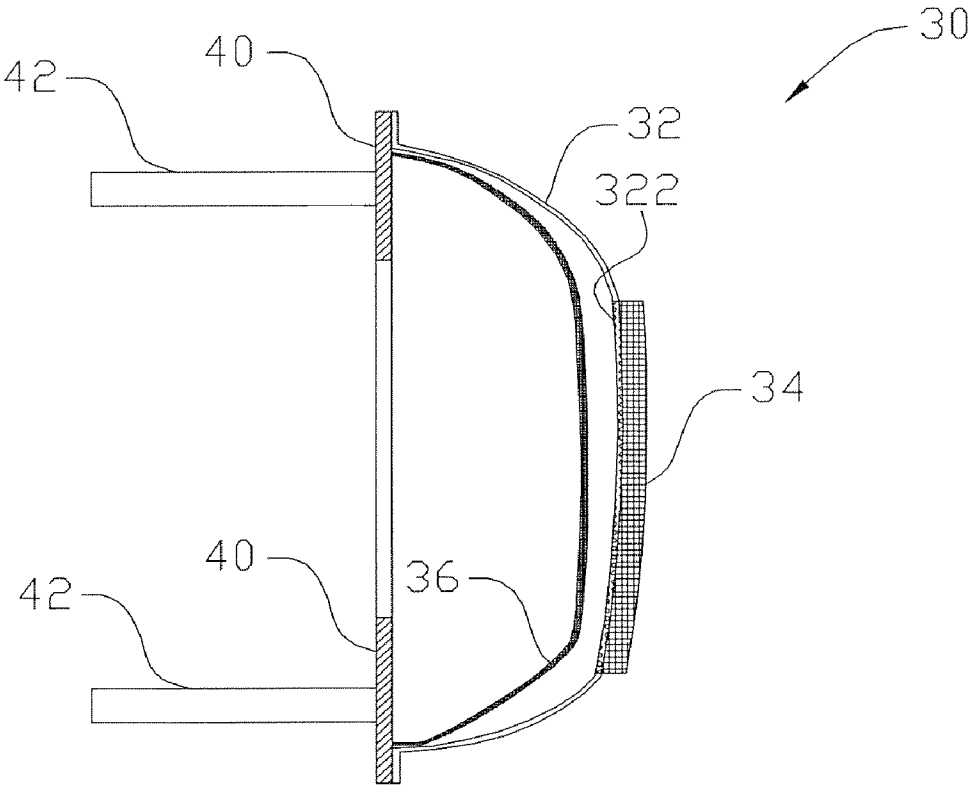
FIG. 3 is a schematic drawing of an embodiment according to the present invention.

Referring to FIG. 3, a complex respirator 30 according to the present invention consists of a first shell 32, at least a first filter layer 34 and a second filter layer 36. The first filter layer 34 is disposed on an outer side of the first shell 32 and a plurality of first air holes 322 is arranged in a central (that is, non-peripheral) portion of the first shell 32 corresponding to the position of the first filter layer 34. The second filter layer 36 is disposed on an inner side of the first shell 32. The second filter layer 36 is made of a material with smaller pore diameter than that of the material of the first filter layer 34. The first filter layer 34 is used to filter organic gas or microorganisms in the air while the second filter layer 36 is for filtering air with material that can't be filtered by the first filter layer 34 such as dust. The first shell 32 is made from a material impermeable to gas, so that the gas intake or exhaust can only passes through the first filter layer 34 and the second filter layer 36 via the first air holes 322.

The filter area of the first filter layer 34 is smaller than that of the second filter layer 36. The first filter layer 34 includes at least a layer of a first filter and a plurality of first microgranular filter media. The first microgranular filter media is distributed uniformly in a plane and is disposed in combination with the first filter, with a mixture setting so that gas passes through the first filter layer 34 uniformly. The second filter layer 36 consists of at least a layer of a second filter and a plurality of second microgranular filter media. The second microgranular filter media is distributed evenly in a plane and is disposed in combination with the second filter, with a mixture setting so that gas passes through the second filter layer 36 uniformly. An air chamber is formed between the second filter layer 36 and the first shell 32 so that intake gas through the first filter layer 34 and the exhaust gas pass the second filter layer 36 uniformly.

Figure 4A:
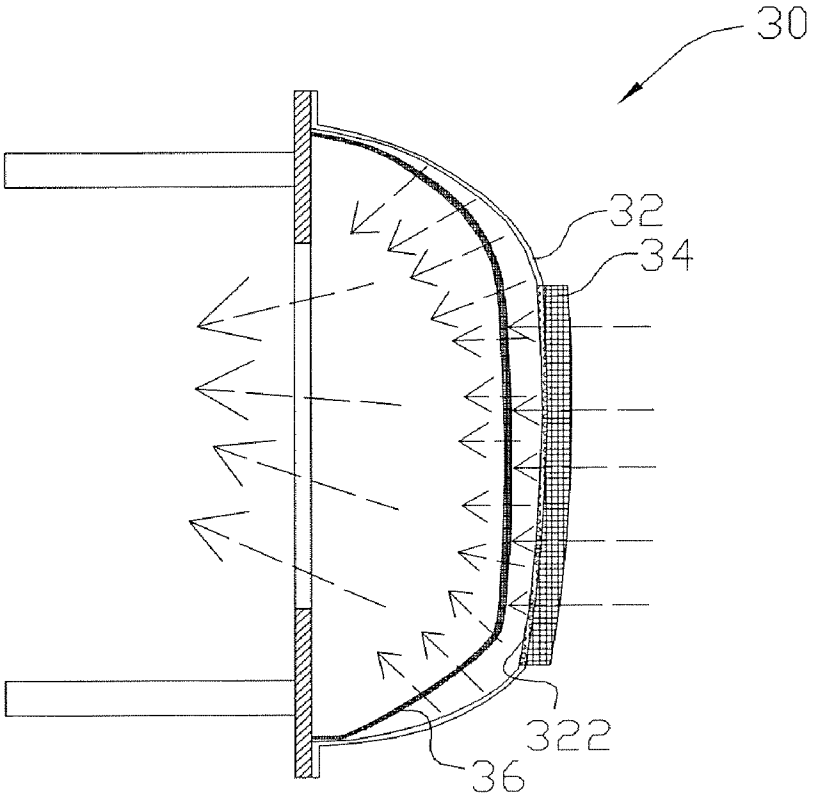
FIG. 4A is a schematic drawing showing air flow of an embodiment according to the present invention.
Figure 4B:
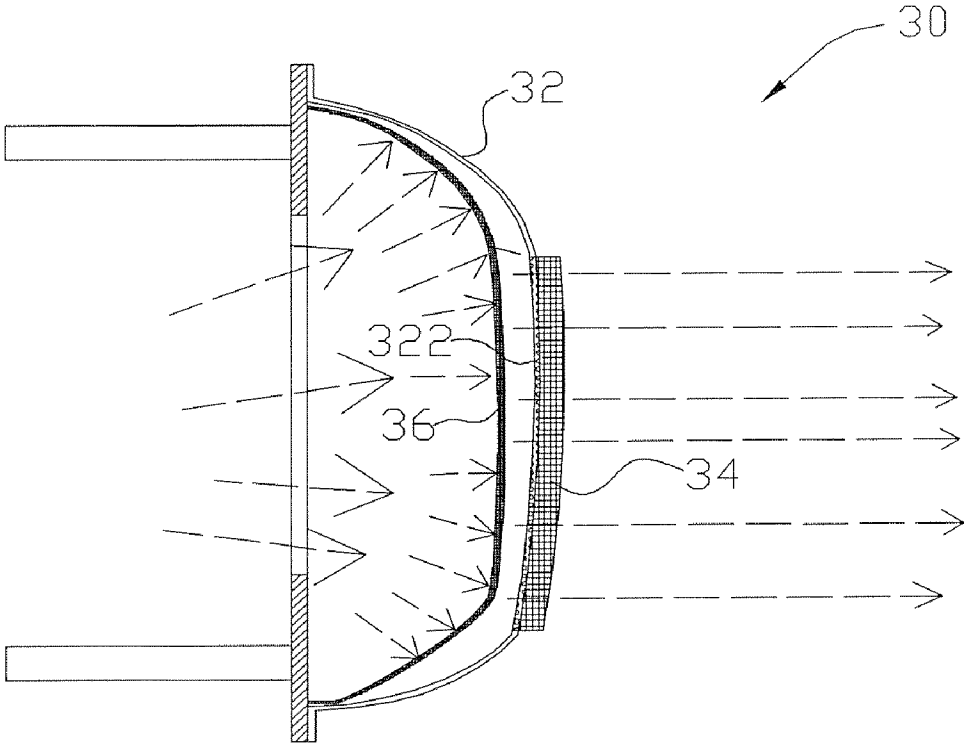
FIG. 4B is a schematic drawing showing air flow of an embodiment according to the present invention.

Refer to FIG. 4A, there is shown use a complex respirator 30 according to the present invention to inhale air from outside. Because the first shell 32 is made from a gas impermeable material, outside air can't flow through the first shell 32 and is only able to pass through the first filter layer 34. Then the air passes through the second filter layer 36 uniformly. As shown in FIG. 4B, air exhausted through the complex respirator 30 according to the present invention diffuses uniformly through the second filter layer 36. Yet the gas through the second filter layer 36 can't flow through the first shell 32, it can only pass through the first filter layer 34. Thus, the air inhaled and the air exhausted only pass through the first filter layer 34 and the second filter layer 36. Therefore, the efficiency of the complex respirator 30 for filtering gas is improved.

Figure 5B:
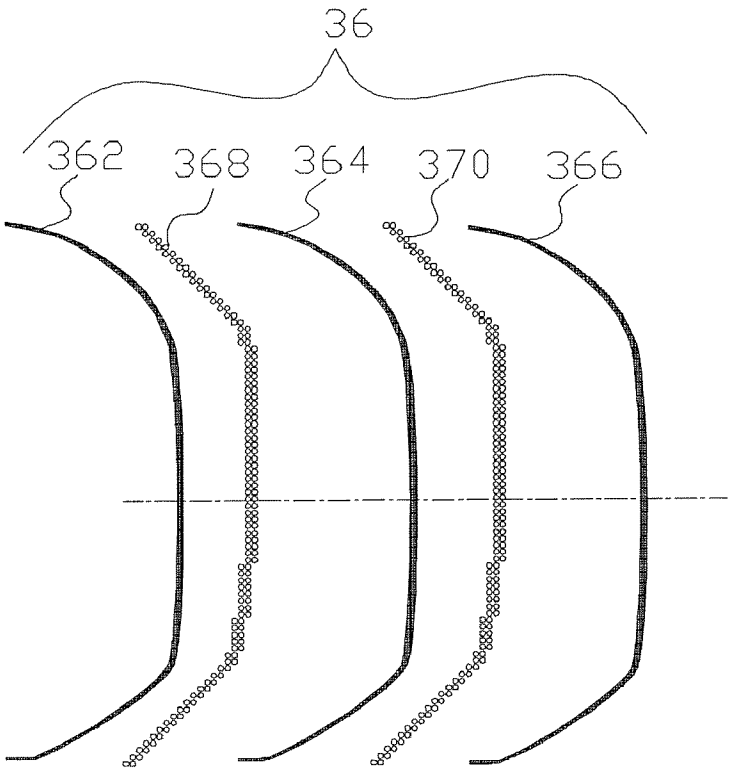
FIG. 5B is a schematic drawing showing filter layers of another embodiment according to the present invention.
Figure 5A:
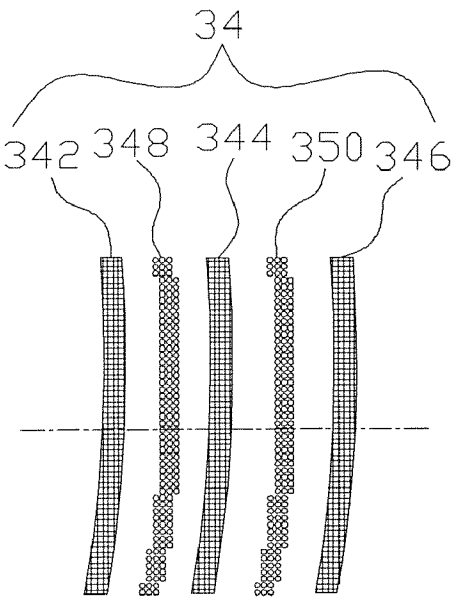
FIG. 5A is a schematic drawing showing filter layers of another embodiment according to the present invention.

As shown in FIG. 5A & FIG. 5B, the first filter layer 34 includes a plurality of layers of first filter 342, 344, 346 and a plurality of layers of first microgranular filter media 348, 350 while the second filter layer 36 includes a plurality of layers of second filter 362, 364, 366 and a plurality of layers of second microgranular filter media 368, 370. Both the first microgranular filter media layers 348, 350 and the second microgranular filter media layers 368, 370 have a plurality of microgranular filter media so as to make gas impassable along fixed paths through the first filter layer 34 and the second filter layer 36, respectively. Also, by means of a chamber located between the second filter layer 36 and the first shell 32, gas inhaled or exhaled diffuses uniformly through the second filter layer 36. Thus, the lifetime of the first filter layer 34 as well as the second filter layer 36 of the complex respirator 30, of the present invention, is extended.

Referring to FIG. 3, a chamber between the second filter layer 36 and the first shell 34 provides a buffering space for pressure from gas so that people don't need to breath hard to get air in while breathing, and pressure coming from breathing won't cause deformation of the complex respirator 30. While wearing the respirator 30, breathing won't become difficult.

Moreover, the complex respirator 30 further includes a first fixing member 40 and a second fixing member 42. The first fixing member 40 is disposed on edge of the first shell 32 for fixing a user's mouth and nose inside the covering area of the first shell 32. The second fixing member 42 includes two circular threads, respectively connected with right and left sides of the first fixing member 40 for preventing the complex respirator 30 of the present invention from falling or loosening from the face of the user. Therefore, the complex respirator 30 according to the present invention goes over the nose and mouth completely without a gap between the respirator and the face of a user, so as to prevent dirty air flowing into the inner space covered by the first shell 32.

The complex respirator 30 according to the present invention totally separates the nose and mouse from air outside and buffers pressure generated during breathing by the air chamber. Thus people are able to make use the complex respirator 30 to obtain clean air easily and breathe comfortably.

Figure 6:
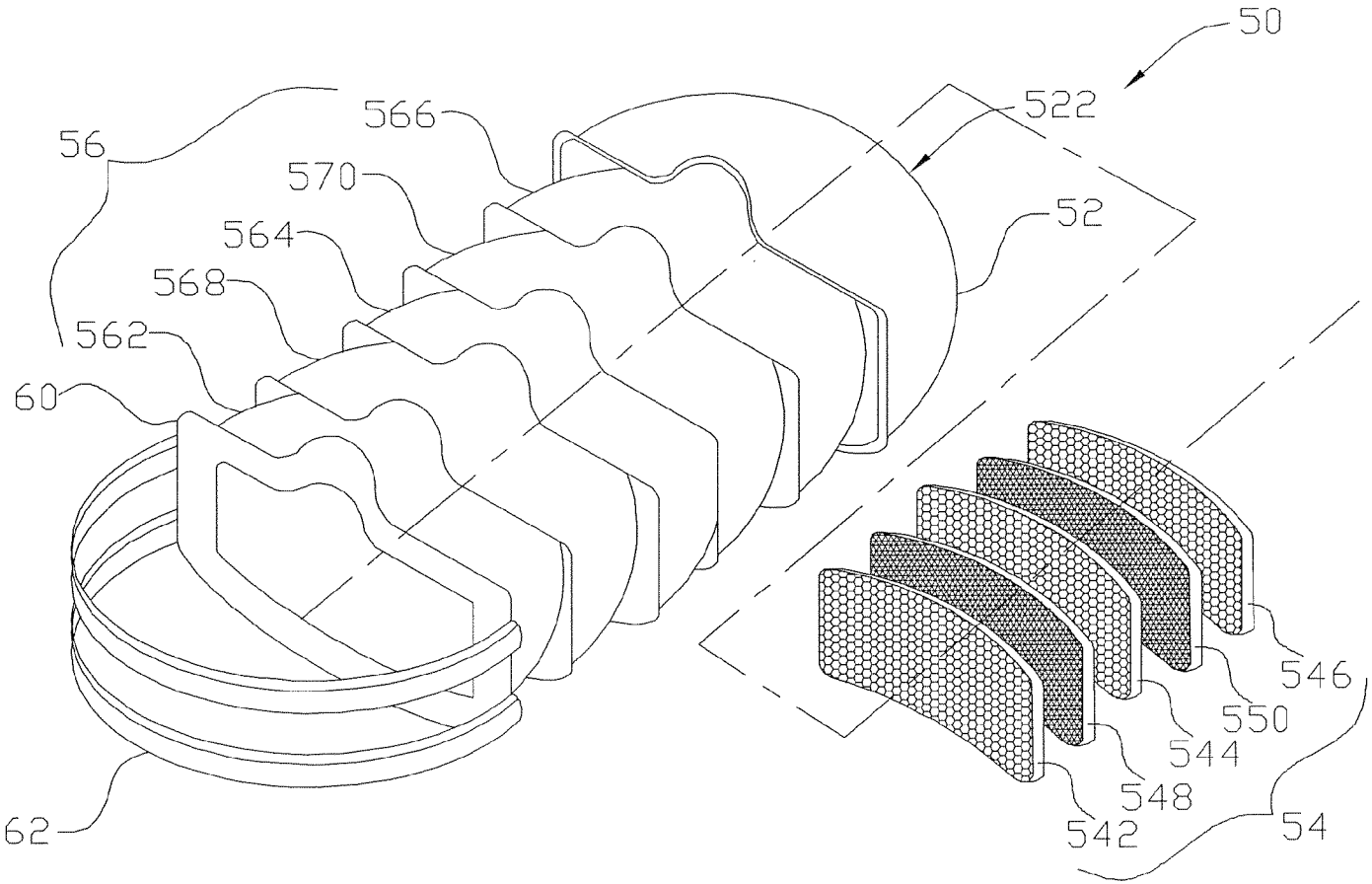
FIG. 6 is a schematic drawing showing structure of a further embodiment according to the present invention.

Refer to FIG. 6, the difference between the embodiment in this figure and the embodiment in FIG. 3 is that in FIG. 3, a plurality of first air holes 322 is arranged on the first shell 32 corresponding to the position of the first filter layer 34, while in FIG. 6, a first air vent 522 is disposed on the first shell 52 corresponding to the position of the first filter layer 54. Moreover, the first filter layer 54 and the second filter layer 56 both include a plurality of layers of a beehive filter and a plurality of layers of an anti-bacteria, bacteriostatic and deodorization layer. The beehive filter consists of a plenty of beehive cells and each of the beehive cells is contains a microgranular filter media therein. A complex respirator 50 according to the present invention includes the first vent 522 arranged on the first shell 52 so that air inhaled and exhaled air pass through the large area of first filter layer 54.

In this embodiment, the first filter layer 54 is composed of three layers of first beehive filter 542, 544, 546 and two layers of first bacteriostatic and deodorization layer 548, 550, that are made from bacteriostatic and deodorization fiber material. The second filter layer 56 consists of three layers of second beehive filter 562, 564, 566 and two layers of second bacteriostatic and deodorization layer 568, 570, that are made from bacteriostatic and deodorization fiber material. When air flows through the first filter layer 54 and the second filter layer 56, it can't pass in a fixed path due to the beehive filter. By means of an air chamber formed between the second filter layer 56 and the first shell 52, air inhaled or exhaled through the complex respirator 50 passes uniformly through the first filter layer 54 as well as the second filter layer 56. The lifetime of the filter layer 54 and the second filter layer of the complex respirator 50 according to the present invention is extended.

Furthermore, when the first filter layer 54 can't filter the air continuingly, it can be replaced by another new piece of the first filter layer 54 that had not been used yet. Thus the complex respirator 50 according to the present invention reduces the amount of garbage from respirators. Because the first filter layer 54 is replaceable, users can choose the first filter layer 54 from those made from various materials depending on the place they intend to go. For example, if the destination is hospital, the first filter layer 54 chosen would be made from anti-bacteria or bactericidal material. If the place is a construction site, the first filter layer 54 chosen would be a material for filtering dust. If the place is a chemical factory, the first filter layer 54 chosen would be made from material that filter chemicals.

Figure 7:
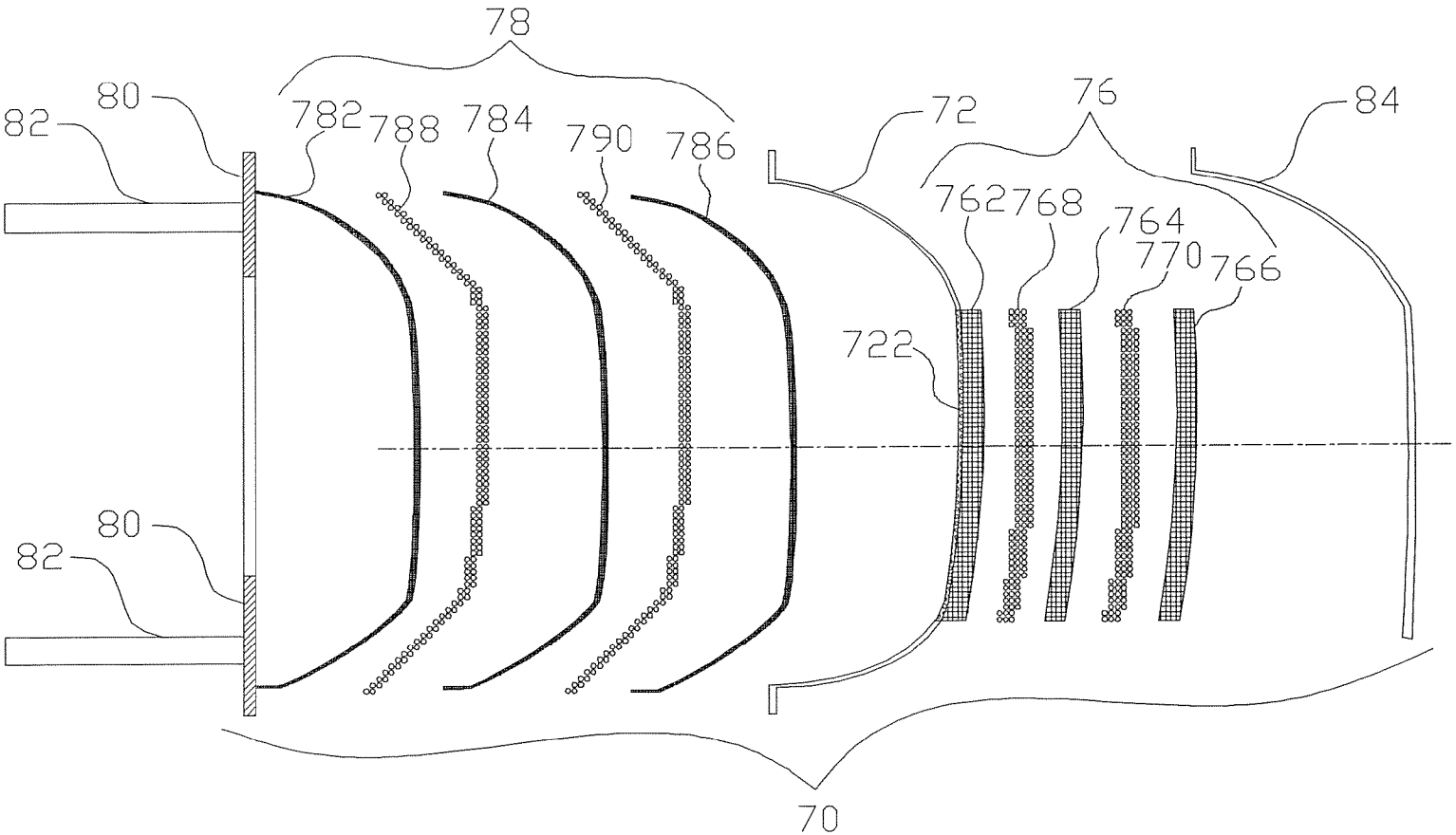
FIG. 7 is a schematic drawing showing structure of a further embodiment according to the present invention.

Refer to FIG. 7, the difference between the embodiment in FIG. 7 and the embodiment in FIG. 3 is that the embodiment in this figure includes a first shell 72 that connects with a cap 74 having air holes 742 for fixing a first filter layer 76 on the first shell 72 and a second shell 84 for protecting the first filter layer 76 from being exposed to drops of water. The cap 74 and the second shell 84 are arranged on the outer side of the first shell 72. The top side, and edges on right and left sides of the second shell 84 connect with the first shell 72 so as to form an open space having an opening facing downwards. Thus, air passes in and out through the opening of the open space without separation of the second shell 84. The second shell 84 is also made from impermeable material so that water drops can't pass. Thus the deformation or malfunction of micro-granular filter media caused by influence of the water drops is avoided.

Figure 8A:
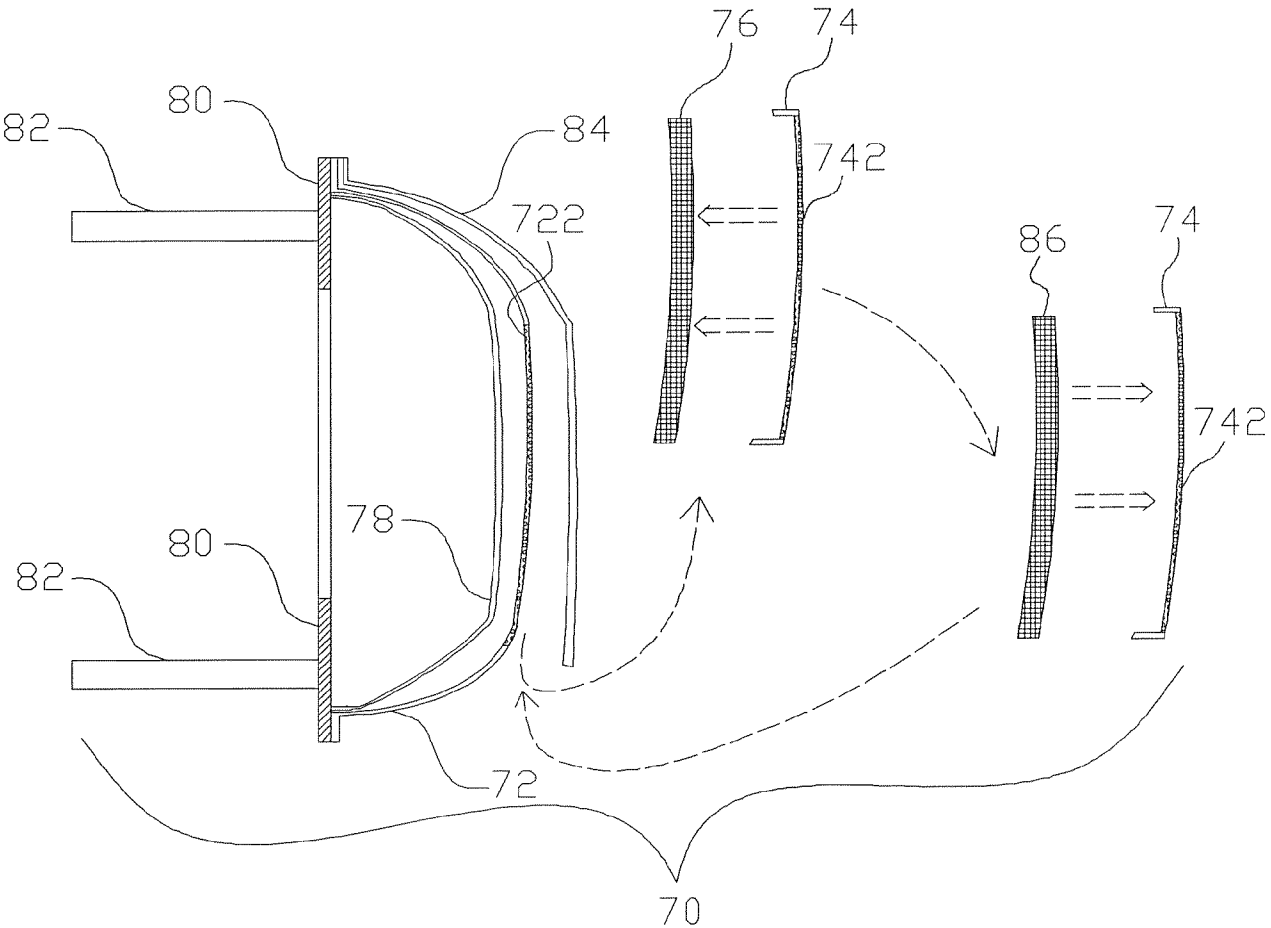
FIG. 8A is a schematic drawing showing the replacement of the filter layer.
Figure 8B:
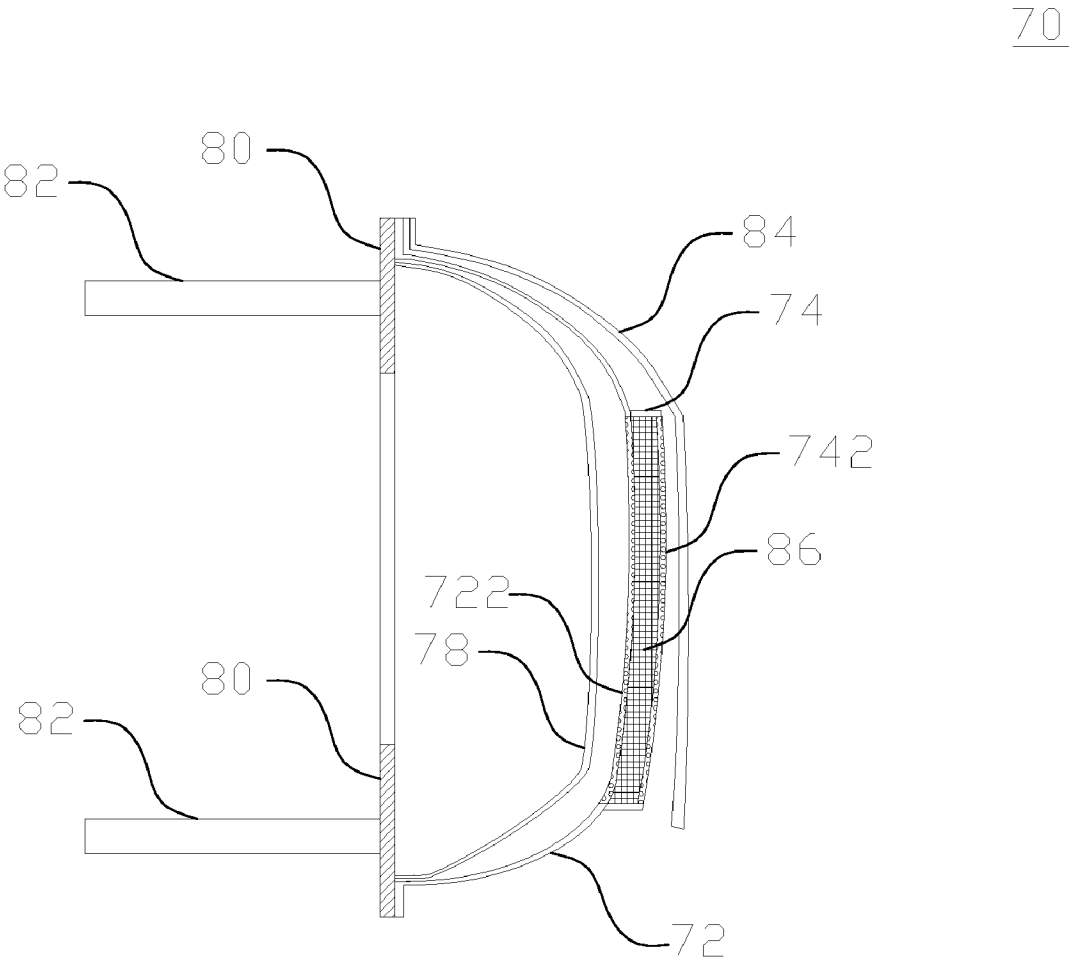
FIG. 8B is a schematic drawing showing structure of a further embodiment according to the present invention.

The first filter layer 76 is fixed in a slot 722 of the first shell 72 by the cap 74 that is arranged on the outer side of the slot 722, corresponding to the opening of the open space for convenience of replacing the used first filter layer 76. As shown in FIG. 8A, when the first filter layer 76 no longer filters the air inhaled or exhaled, the cap 74 is opened for replacing the first filter layer 76 with a new first filter layer 86 that has not been used yet. After the new first filter layer 86 is disposed inside the slot 722 of the first shell 72, the cap 74 secures the first filter layer 86, as shown in FIG. 8B.

Figure 9A:
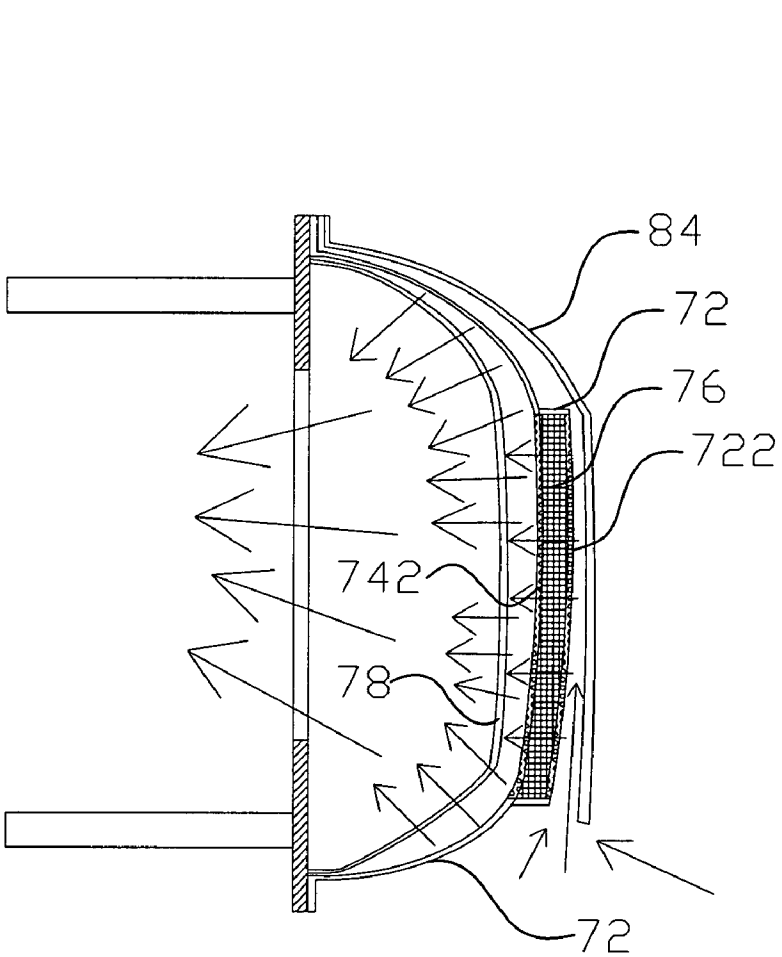
FIG. 9A is a schematic drawing showing air flow of a further embodiment according to the present invention.
Figure 9B:
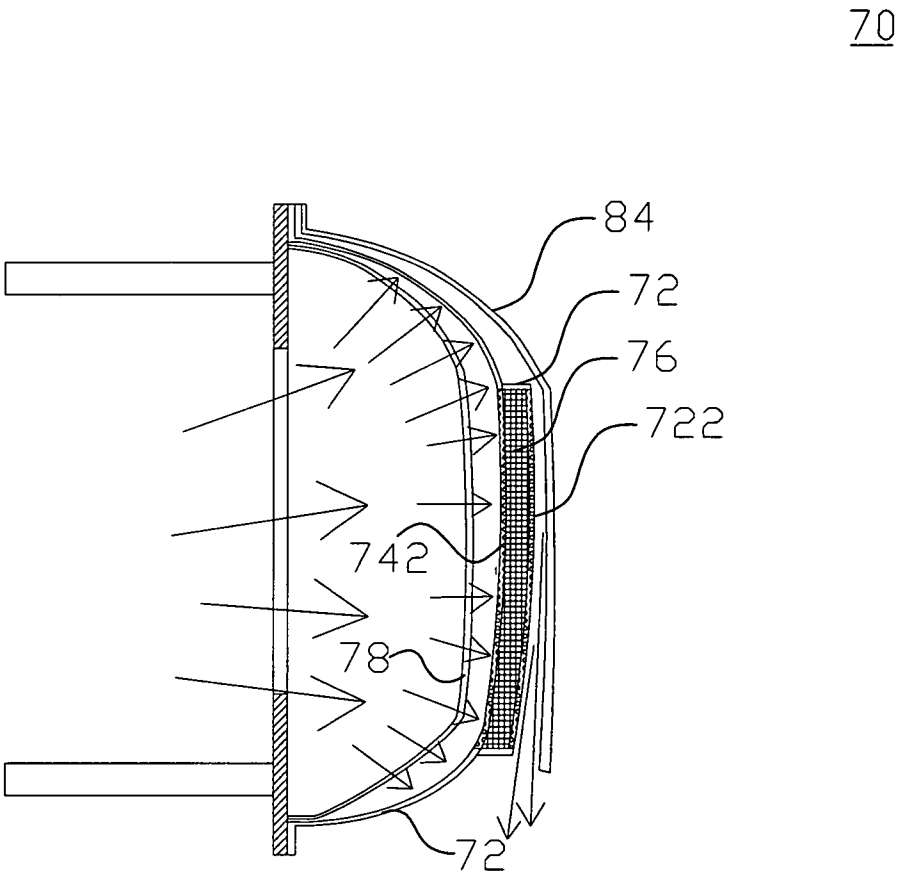
FIG. 9B is a schematic drawing showing air flow of a further embodiment according to the present invention.

Refer to FIG. 9A, while people using the complex respirator 70 of the present invention to inhale air, air outside firstly flows into the open space that has on opening facing downwards and is located between the first shell 72 and the second shell 84, because the first shell 72 is impermeable and air can't pass through it. Then, the air passes through the first filter layer 76. Next, the air passes through and diffuses uniformly through the second filter layer 78. Referring to FIG. 9B, when people use the complex respirator 70 of the present invention to exhale air, the exhausted air diffuses through the second filter layer 78 uniformly. However, the air that has passed therethrough can't flow through the first shell 72. Instead, it can only pass through the first filter layer 76 into the open space and flow out through the opening thereof facing downwards. Therefore, the second shell 84 has no influence on the breathing of users.

Figure 10:
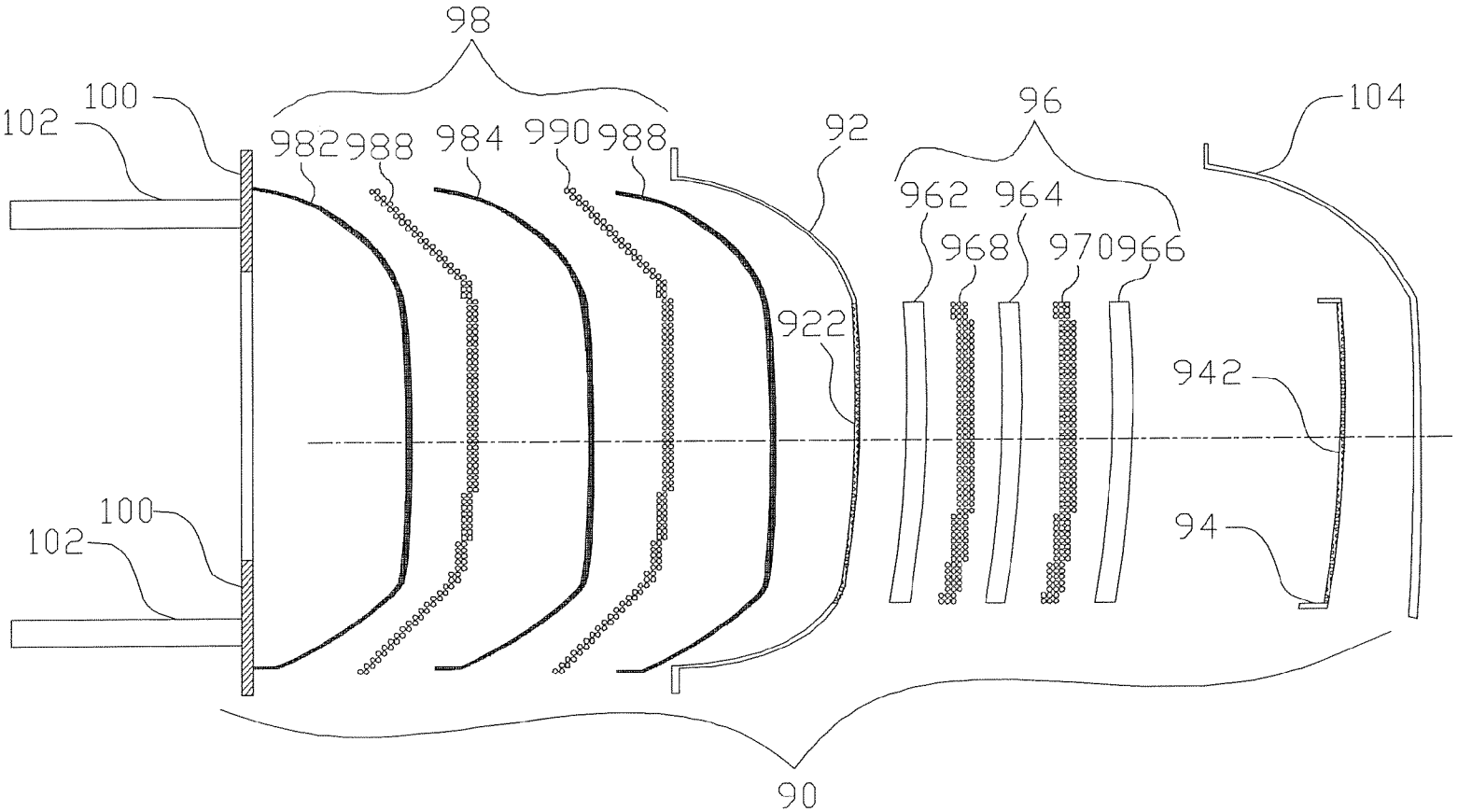
FIG. 10 is a schematic drawing showing structure of a further embodiment according to the present invention.

Refer to FIG. 10, the difference between the embodiment in FIG. 3 (7) and the embodiment in FIG. 10 is that the first filter layer 76 of the embodiment in the FIG. 3 (7) includes three layers of the first filter 762, 764, 766, while a first filter layer 96 of the embodiment in the FIG. 10 includes three layers of a positioning plate 962, 964, 966. A complex respirator 90 of the present invention fixes two layers of the first microgranular filter media 968, 970 by means of the three layers of the positioning plate 962, 964, 966. The two layers of the first microgranular filter media 968, 970 are arranged between two of the three layers of positioning plate 962, 964, 966 to form two spaces for air flow so that the flow path of the air inhaled or exhaled is not fixed. By means of an air chamber between a first filter layer 96 and a second filter layer 98, the complex respirator 90 causes air to uniformly pass through the first filter layer 96 as well as the second filter layer 98. Thus, the lifetime of the first filter layer 96, as well as the second filter layer 98, of the complex respirator 90 is extended.

In addition, a complex respirator is not only for healthy people but also for patients. Patients who use such respirators can prevent droplet-transmitted bacteria or viruses from spreading to neighboring areas. The second filter layer made from bactericidal or anti-bacteria filter material filters bacteria or viruses to prevent infections such as flu or Severe Acute Respiratory Syndrome (SARS) from spreading rapidly.

In summary, the present invention provides a complex respirator that includes a first shell, a second shell, at least a first filter layer and a second filter layer. The first shell is disposed on inner side of the first filter layer while the second filter layer is arranged on inner side of the first shell. A slot is formed between the first shell and the second filter layer. The first filter layer is arranged in the slot and the second filter layer is set on inner side of the first shell. The air inhaled firstly passes through the first filter layer and then through the second filter layer. While the air exhaled flows through the second filter layer and then through the first filter layer. For the inhaled air, the first filter layer is for filtering particles of dust and the second filter layer is for filtering granules of a smaller diameter. As to the exhaled air, the second filter layer filters bacteria or other impurities. Use of the complex respirator by healthy people avoids the inhalation of toxic gas or harmful granules. If patients use the complex respirators, the respirator prevents micro-organisms carried by patients from spreading to surrounding areas.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A complex respirator comprising:

at least one first filter layer having longitudinal and transverse dimensions defining a first area;

a shell formed of a gas impermeable material and disposed on an inner side of the first filter layer, the shell including an outer edge defined about a central portion having at least one air hole formed therethrough disposed in correspondence with the first filter layer; and a second filter layer having longitudinal and transverse dimensions defining a second area, the second area being greater than the first area, the second filter layer being joined to the outer edge of the shell to be substantially in peripheral alignment with the shell to form an air chamber and remain spaced from an inner side of the shell by the air chamber, the air chamber extending between the inner side of the shell and the second filter layer peripherally beyond the first filter layer to provide a peripherally expanded air buffering space about the air hole of the shell.

2. The device as claimed in claim 1, wherein a slot is formed on one side of the shell and the first filter layer is disposed in the slot.

3. A complex respirator comprising:

a shell formed of an impermeable material and including an outer edge defined about a central portion having at least one air hole formed therethrough;

at least one first filter layer coupled to an outer side of the shell in correspondence with the air hole; and a second filter layer being coupled to the outer edge of the shell to be substantially in peripheral alignment with the shell to form an air chamber and remain spaced from an inner side of the shell by the air chamber, the air chamber extending between the inner side of the shell and the second filter layer peripherally beyond the first filter layer to provide a peripherally expanded air buffering space about the air hole of the shell;

wherein, a pore size of the first filter layer is larger than a pore size of the second filter layer.

4. The device as claimed in claim 3, wherein the first filter layer is for filtering organic gas or bacteria laden air.

5. The device as claimed in claim 3, wherein a pore size of the second filter layer is smaller than a diameter of dust.

6. The device as claimed in claim 3, further comprising a separation layer located between the first filter layer and the second filter layer.

7. A complex respirator comprising:

a first shell formed of an impermeable material and having a slot formed therein, the first shell including an outer edge defined about a central portion having at least one air hole formed therethrough in correspondence with the slot;

at least one first filter layer having at least one first filter disposed in the slot and overlaying the air hole; and a second filter layer being coupled to the outer edge of the shell to be substantially in peripheral alignment with the shell to form an air chamber and remain spaced from an inner side of the first shell by the air chamber, the air chamber extending between the inner side of the first shell and the second filter layer peripherally beyond the first filter layer to provide a peripherally expanded air buffering space about the air hole of the first shell.

8. The device as claimed in claim 7, wherein the first filter layer further includes a plurality of microgranular filter medium.

9. The device as claimed in claim 8, wherein the first filter layer further comprises a beehive filter having a plurality of beehive cells, the plurality of microgranular filter medium being respectively disposed in the plurality of beehive cells.

10. The device as claimed in claim 9, wherein the beehive filter is a horizontal structure.

11. The device as claimed in claim 7, wherein the second filter layer comprises at least one second filter.

12. The device as claimed in claim 7, wherein the second filter layer further comprises a plurality of microgranular filter medium.

13. The device as claimed in claim 12, wherein the second filter layer further includes a beehive filter having a plurality of beehive cells, the plurality of microgranular filter medium being respectively disposed in the plurality of beehive cells.

14. The device as claimed in claim 13, wherein the beehive filter is a horizontal structure.

15. The device as claimed in claim 7, further comprising a second shell being disposed on outer side of the first shell connecting with edges of top, left and right sides of the first shell to form an open space facing downwardly when the complex respirator is worn by a user.

16. The device as claimed in claim 15, wherein the second shell is made from an impermeable material.

17. The device as claimed in claim 7, wherein the first filter layer comprises at least one positioning plate and a plurality of microgranular filter medium and the microgranular filter medium are fixed by means of the positioning plate.

18. The device as claimed in claim 7, wherein a cap is set on an outer side of the slot for securing the first filter layer on the first shell and at least one second air hole is formed in the cap in correspondence with the first filter layer.

* * * * *